United States Patent [19]

Johnston et al.

[11] Patent Number: 4,764,047

[45] Date of Patent: Aug. 16, 1988

[54] VEHICLE AND PATIO WASHING BRUSH

[75] Inventors: Damon A. Johnston, Aurora; Paul E. Papenhause, St. Charles; George L. Garcia, Naperville; Thomas L. Drehobl, Lindenhurst, all of Ill.

[73] Assignee: Suncast Corporation, Batavia, Ill.

[21] Appl. No.: 53,089

[22] Filed: May 22, 1987

[51] Int. Cl.[4] ..... F23D 13/38; A46B 11/06

[52] U.S. Cl. ..... 401/289; 401/42; 401/280; 137/625.48; 137/874; 251/325

[58] Field of Search ..... 401/42, 43, 270, 278–281, 401/289; 251/325, 340; 137/625.11, 625.48, 874; 15/53 R

[56] References Cited

U.S. PATENT DOCUMENTS

| | | | |
|---|---|---|---|
| 2,616,660 | 11/1952 | Morehouse | 401/270 X |
| 2,645,450 | 7/1953 | Chessman | 251/325 |
| 3,581,998 | 6/1971 | Roche | 401/43 X |

FOREIGN PATENT DOCUMENTS

| | | | |
|---|---|---|---|
| 506349 | 12/1954 | Italy | 401/43 |

*Primary Examiner*—Richard J. Apley

*Assistant Examiner*—Franklin Gubernick

*Attorney, Agent, or Firm*—Fitch, Even, Tabin & Flannery

[57] ABSTRACT

A brush for home use such as washing cars and patios. The brush includes a body having a plurality of dependent bristles and defining a first compartment for a receiving soap and a second compartment for receiving rinse water. The body also includes an elongate tube partially defining each of the compartments. The first compartment has an outlet for providing soapy water to the bristles while the second compartment has an outlet for providing rinse water. A spool valve is slidable back and forth in the tube with the valve having a tubular wall defining an axial bore open to the conduit and an opening extending through the wall for communicating water to either of the compartments. Seals are carried by the spool valves flanking the opening to provide watertight seals between the valve and the tube. The brush also includes a thumb switch for reciprocating the valve along a linear path among a soap position, a rinse position, and an off position where water is supplied to neither of the compartments.

19 Claims, 5 Drawing Sheets

VEHICLE AND PATIO WASHING BRUSH

The subject invention relates to cleaning apparatus and, more particularly, to a washing, scrubbing and rinsing brush for home uses such as washing vehicles and patios.

BACKGROUND OF THE INVENTION

Outside cleaning activities around the home, such as washing vehicles, are usually carried out by first wetting the object to be washed using a garden hose. Next soapy water is applied and a brush or sponge is used to loosen the dirt with a scrubbing action. This requires the use of a bucket for holding the soapy water. The object is then rinsed to remove the soapy water in which the dirt is dissolved or suspended. It will be appreciated that this method of cleaning is time consuming, requires a large amount of bending and causes the person washing the object to become wet.

Various types of brushes have been proposed over the years for attachment to a hose to scrub and rinse an automobile. One type of such brush can be used to dispense either soapy water or clear rinse water. For further information concerning the structure and operation of such a brush, reference may be made to U.S. Pat. No. 1,655,375. In another type of such brush, water can either be supplied to the bristles carried by the brush or to the nozzle of the brush for providing a stream of water to wash away dirt. For further information concerning the structure and operation of this type of brush, reference may be made to U.S. Pat. Nos. 1,676,857, 1,775,221 and 4,552,476.

Either type of brush requires the operator to use both hands in switching from one operating mode of the brush to another. This usually involves rotating a valve member with one hand while holding the brush with the other. Alternatively, it might involve moving the water outlet from one opening in the brush body to another. In either event such switching is inconvenient and may require the operator to watch for proper positioning of the switching means.

SUMMARY OF THE INVENTION

Among the aspects and features of the present invention may be noted the provision of an improved brush for home use such as washing vehicles and patios. The brush dispenses either soapy water or rinse water, and can be held and switched, using only one hand among rinse, soap and off positions. The brush will not leak substantial water when in its off position. Furthermore, it will not provide substantial soapy water when shifted to its rinse position. It also will not leak substantial amounts of soap when switched off. The brush provides a tactile indication of each of its three operating positions so that the operator need not look at the brush while changing operating modes. The brush of the present invention is lightweight and made almost entirely of molded plastic components. The brush furthermore is reliable in use, has long service life and is relatively easy and economical to manufacture. Other aspects and features of the present invention will be in part apparent and in part pointed out in the following specification and in the accompanying drawings.

Briefly, a brush embodying various features of the present invention includes a body having a plurality of dependent bristles. The body defines a first compartment for receiving soap and a second compartment for receiving rinse water. The compartments are separated by a barrier wall and the body further includes an elongate tube partially defining each of the compartments. The first compartment includes an outlet for providing soapy water to the bristles while the second compartment has a nozzle for emitting a stream of rinse water. The brush further includes a conduit joined to the tube for connection to a garden hose. A spool valve is slidable back and forth in the tube with the valve having a wall defining an axial bore open to the conduit, and an opening extending through the wall for communicating water to either of the compartments. The tube has a first aperture for providing water to the first compartment and a second aperture for providing water into the second compartment. The spool valve carries spaced seals flanking the opening for providing substantially watertight seals between the valve and the tube. A thumb switch is provided for reciprocating the spool valve along a substantially linear path among a soap position wherein the first aperture is flanked by the seals, a rinse position in which the second aperture is flanked by the seals, and an off position in which neither of the apertures is flanked by the seals. Thus, movement of the spool valve to the soap position causes soapy water to be provided to the bristles, movement of the valve to the rinse position results in clear water being ejected from the brush and movement of the spool valve to the off position shuts off the water.

BRIEF DESCRIPTION OF THE DRAWINGS

Corresponding reference characters indicate corresponding components throughout the several views of the drawings.

DESCRIPTION OF THE PREFERRED EMBODIMENT

Figure 1:
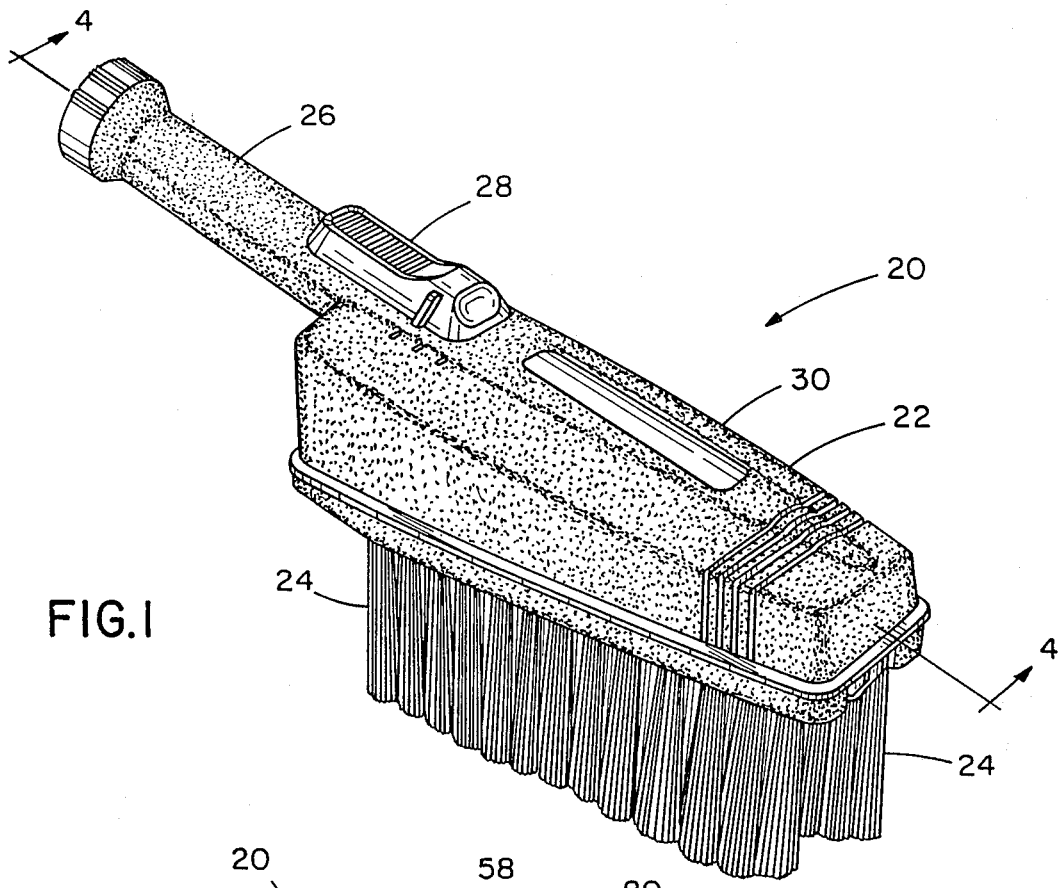
FIG. 1 is a perspective view of a vehicle and patio washing brush embodying various features of the present invention.
Figure 2:
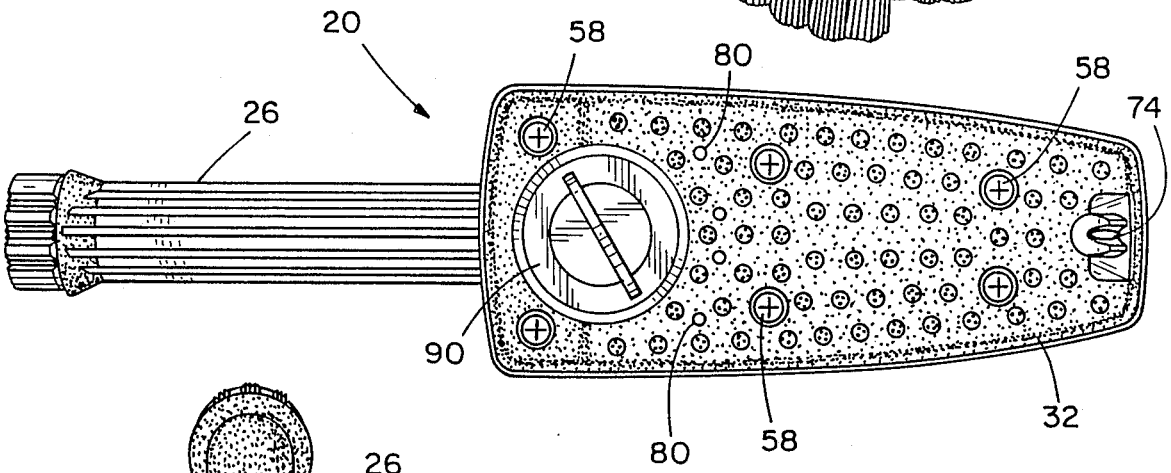
FIG. 2 is a bottom view of the brush of FIG. 1.
Figure 3:
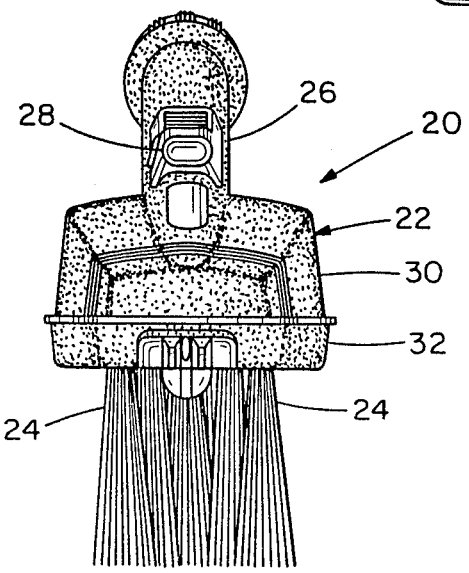
FIG. 3 is a first elevational view of the brush.

Referring now to the drawings, a vehicle and patio washing brush embodying various features of the present invention is generally indicated in FIGS. 1-3 by reference numeral 20. The brush 20 includes a body 22 dependent from which are a plurality of tufts 24 of bristles. A conduit 26, which serves as a handle for the brush, extends from the body and terminates in a distal end having an internal screw thread for connection to the male threaded end of a garden hose (not shown). A thumb switch 28 is positioned near the conduit and can be reciprocated from a forward "off" position, through an intermediate "rinse" position to a rear "soap" position to control operation of the brush. The adjacency of the switch 28 and the conduit 26, coupled with the linear operability of the switch by use of the thumb, allows the brush to be fully utilized by the operator using just one hand.

Figure 14:
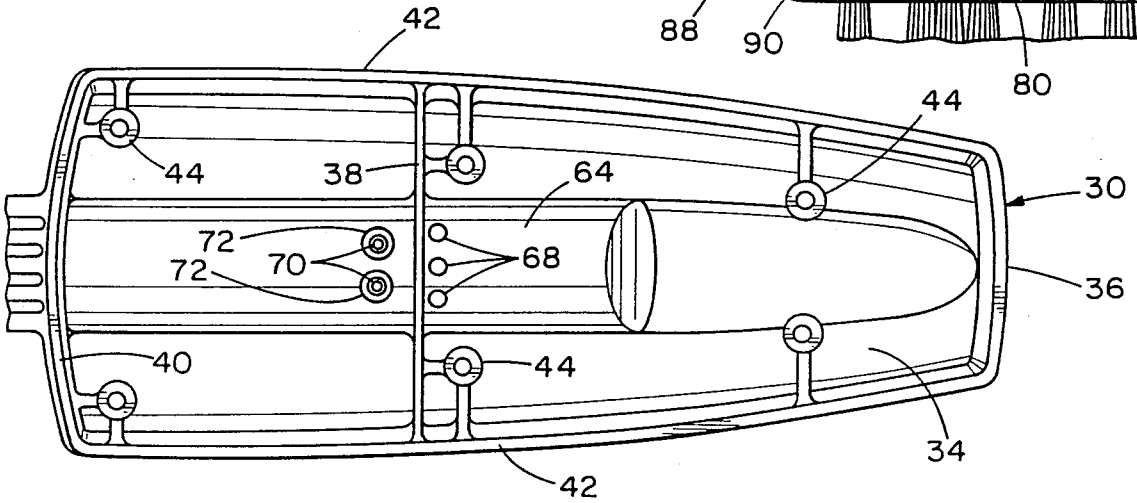
FIG. 14 is a bottom view of the upper body portion of the brush body.
Figure 6:
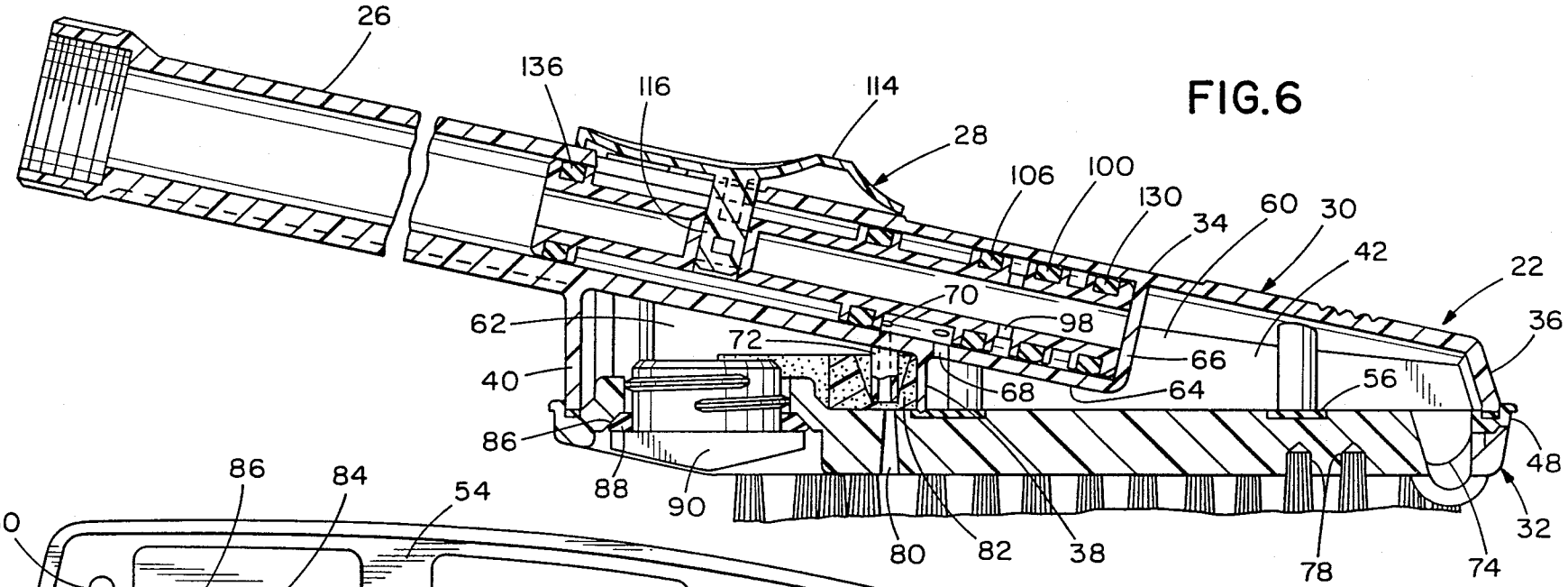
FIG. 6, also similar to FIG. 4, depicts the spool in an "off" position where water is provided to neither the soap compartment nor the rinse compartment.
Figure 15:
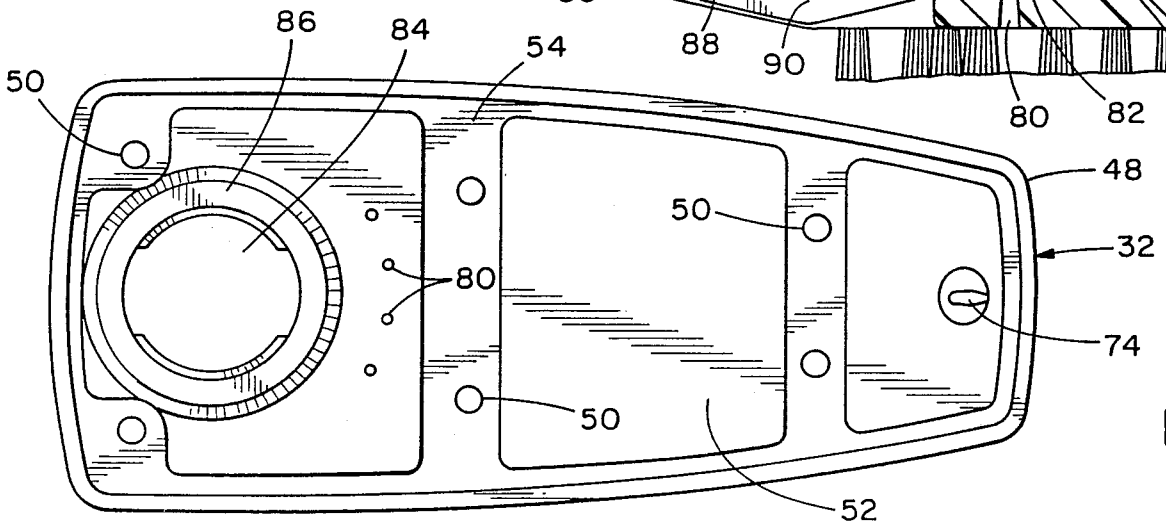
FIG. 15 is a plan view of the base of the brush body.

More specifically, the body 22 includes an upper body portion 30, best shown in FIG. 14, and a base 32, best shown in FIG. 15. The upper body portion includes a top wall 34 from which depends a front wall 36, an intermediate barrier wall, 38, a rear wall 40, side walls 42 interconnecting the front and rear walls, and a forward pair, an intermediate pair and a rear pair of screw-receiving posts 44. The body 22 further includes the base 32 having a peripheral lip 48 for seating the front, rear and side walls of upper body position 30. The base has screw-receiving apertures 50 aligned with posts 44. Furthermore, the upper surface 52 of the base has a recess 54 including a peripheral component disposed inside lip 48, a first cross component underlying the forward pair of posts, and a second cross component underlying the intermediate pair of posts and the intermediate barrier wall 38. A gasket 56 is received in the recess so that with the base 46 attached to the upper body portion 30 by screws 58, watertight seals are formed between the dependent walls of the upper body portion and the base to divide the body 22 into a forward compartment 60 and a rear compartment 62 with the barrier wall 38 spacing the compartments.

The upper body portion 30, which is preferably integral with the conduit 26 and of molded thermoplastic construction, further includes an elongate tube 64 extending from the conduit 26 through the rear compartment 62 and into the forward compartment 60 before terminating in an end wall 66. The tube 64, which partially defines the compartments 60, 62, has a trio of second apertures 68 for providing water to the forward compartment. Tube 64 further has a pair of side-by-side first apertures 70 for providing water to the rear compartment 62. Dependent from the tube 64 are a pair of locating pins 72 which terminate short of the base upper surface 52 and through which pass corresponding apertures 70.

The base 32 is preferably of one-piece molded plastic construction and at its forward end is formed outlet means in the form of a nozzle 74 for providing a stream of clear rinse water from the forward compartment 60. The bottom surface 76 of the base 32 is provided with an array of blind openings 78 for receiving and holding the head ends of the tufts 24 of bristles. Disposed among the blind openings 78 is outlet means for providing soapy water from the rear compartment in the form of an arcuate arrangement of holes 80. The locating pins 72 retain a piece of open cell sponge material 82 over the holes 80.

The base 32 also has a large annular port 84 for pouring liquid soap or soap crystals into the rear compartment 62. The port has an internal screw thread and a peripheral sealing ledge 86 for compressive engagement by an O-ring 88 carried by an externally threaded soap cap 90. The arrangement of the locating pins 72 including the first apertures 70 for providing water to the rear soap compartment 62 offers several advantages. The viscosity of the liquid soap combined with the small cell structures of the sponge material 82 prevents the liquid soap from leaking out holes 80 absent the introduction of pressurized water into the rear compartment through first apertures 70. In the event that the brush is inverted, it is likely that the distal ends of the locating pins 72 will be above the level of the liquid soap. Thus the liquid soap will not flow into the tube 64 through first apertures 70, and accordingly, soapy water will not be introduced into the forward rinse compartment 60.

As best shown in FIGS. 4-6, 9 and 10, the brush 20 also comprises a spool valve 92, preferably of integral molded plastic construction, which is slidable back and forth in the tube 64. The valve has a tubular wall 94 defining an axial through bore 96 for receiving water for the conduit 26, and an opening 98 for communicating water to either of the compartments 60 or 62. The spool valve 92 carries on its outside surface sealing means flanking the opening 98 providing substantially watertight seals between the spool valve and the tube 64. The sealing means includes a first O-ring 100, retained in position by flanges 102 and 104 which are integral with the spool valve, and a second O-ring 106 located by flange 108 and 110.

Figure 7:
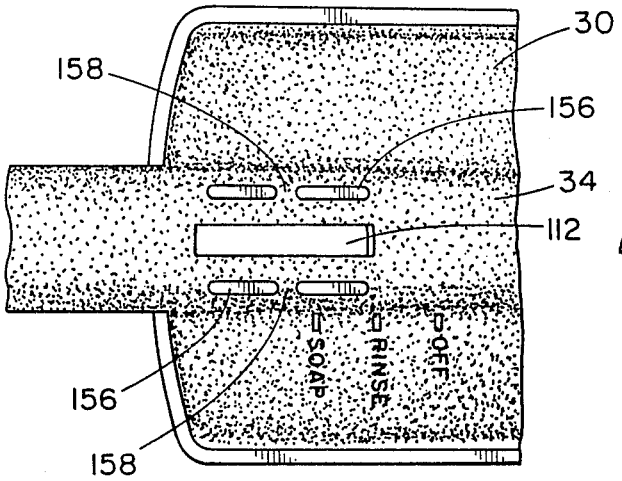
FIG. 7 is a plan view of a portion of the upper body of the brush.
Figure 9:
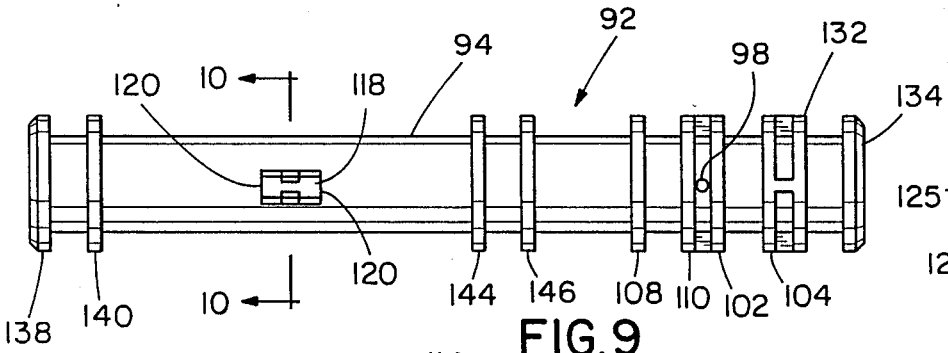
FIG. 9 is a plan view of the slidable spool valve.
Figure 10:
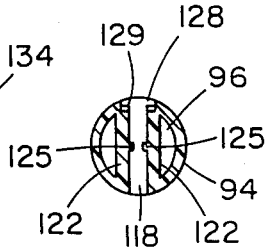
FIG. 10 is a sectional view generally along line 10—10 of FIG. 9.

Referring to FIG. 7, the top wall 34 of the upper body portion 30 has an elongate slot 112 opening to the tube 64. The thumb switch 28, best shown in FIGS. 11 and 12, includes a thumb engagement piece 114 and a stem 116 extending downwardly therefrom through the slot 112 and into a recess 118 in the spool valve. As depicted in FIGS. 9 and 10, the recess 118 is defined by spaced lateral walls 120 and spaced axial walls 122 which together isolate the recess 118 from the axial bore 96. The stem 116 has a window 124 and the opposing axial walls 122 have facing protuberances 125 for reception by the window when the stem is properly located in the recess. The stem 116 is also provided with side ribs 126 terminating above the level of the window. The axial walls 122 have facing depressions 128 at their upper ends adjoining recess 118 for receiving the ribs 126. Each depression 129 is partially defined by an internal ledge 128 for abutting a corresponding side rib 126 to limit the extent of insertion of the stem into the recess to the level where the protuberances 125 are received in the window 124.

The thumb switch 28 serves as means for reciprocating the spool valve 92 along a substantially linear path from a rear "soap" position (shown in FIG. 4) wherein the O-rings 100, 106 flank the first apertures 70, through a rinse position (shown in FIG. 5) wherein the O-rings flank the second aperture 68, to a forward "off" position (shown in FIG. 6) in which apertures 68 or 70 are not flanked by the sealing means to shut off the supplying of water. Note that the axial bore 96 extends completely through the spool valve 92. If the bore were closed at the forward end of the valve, the pressure of the water might bias the valve to its off position.

Figure 4:
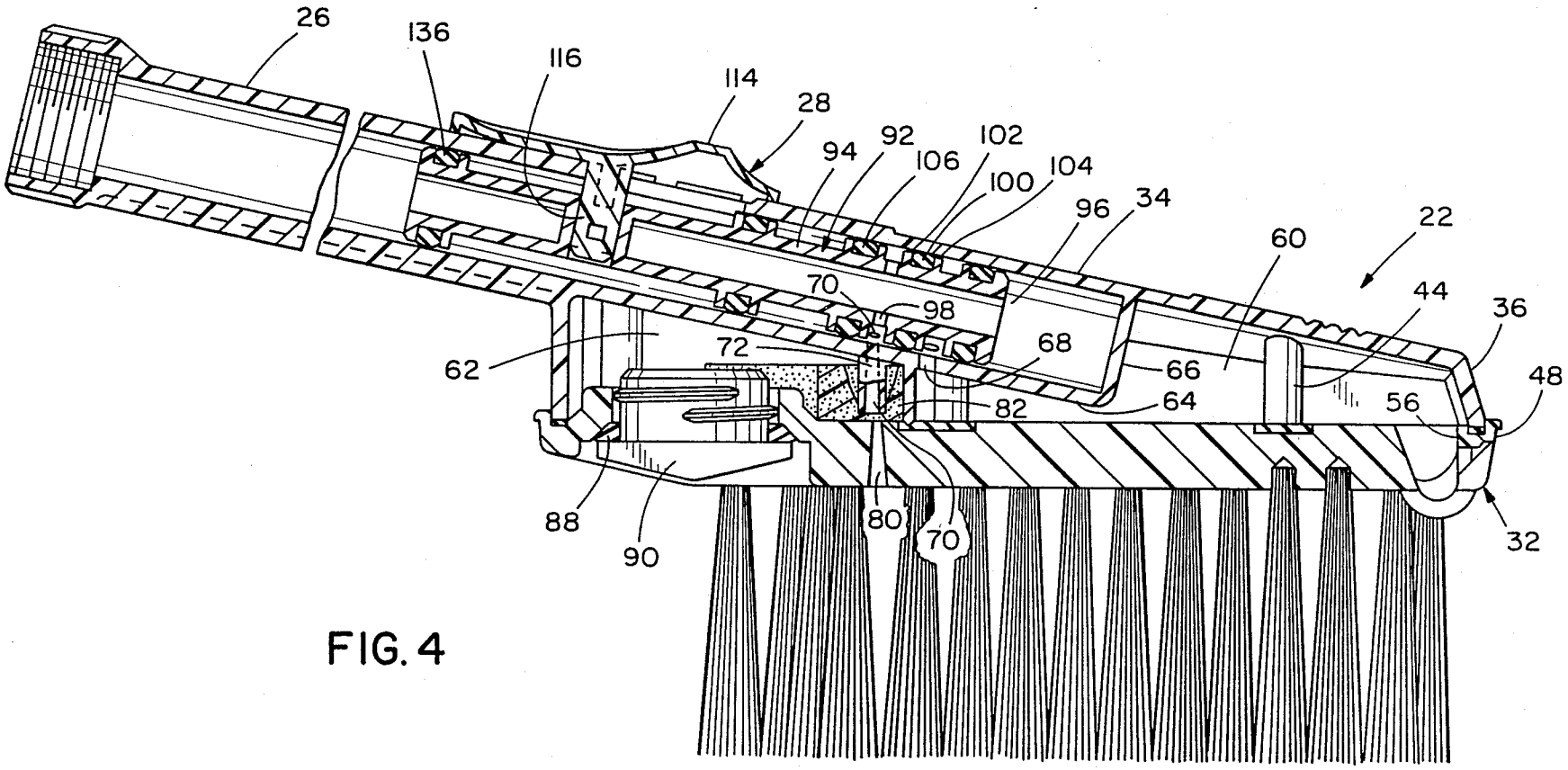
FIG. 4 is a longitudinal cross-sectional of the brush illustrating a slidable spool valve in position to provide water to a soap compartment defined in the body of the brush.
Figure 5:
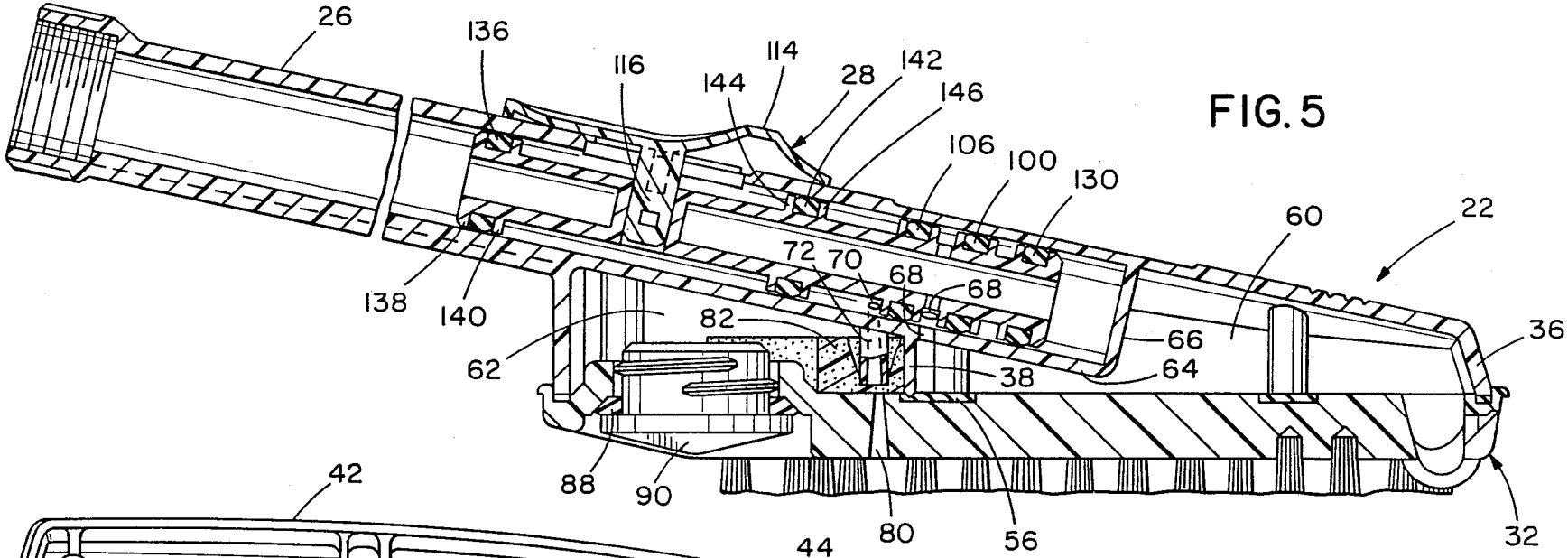
FIG. 5, similar to FIG. 4, shows the valve in position to provide water to a rinse compartment defined in the body the brush.

The spool valve 92 carries a third O-ring 130 adjacent its forward end retained by flanges 132 and 134 to seal the forward end of the valve from the second aperture 68 to the forward compartment 60 when the valve 92 is in its soap position (FIG. 4). A fourth O-ring 136, disposed adjacent the rear of the valve and located by flanges 138 and 140, provides a seal between the conduit 26 and the slot 112 in the top wall 34. Finally, a fifth O-ring 142 carried by the valve and located by flanges 144 and 146 seals the slot from first apertures 70 so that soapy water is precluded from leaking around the thumb switch 28.

Figure 11:
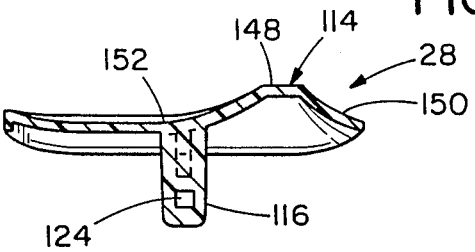
FIG. 11 is a cross-sectional view of a thumb switch for moving the spool valve.
Figure 12:
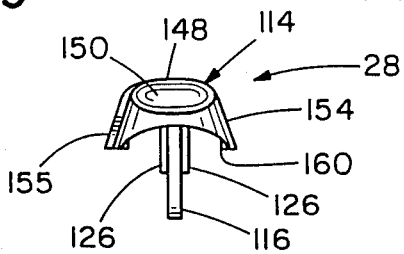
FIG. 12 is a front elevational view of the thumb switch.

The thumb engagement piece 114, as best shown in FIGS. 11 and 12, includes a crest surface 148 and a forward surface 150 inclined downwardly from the crest surface for engagement in moving the switch 28 rearwardly. The piece also includes a rear surface 152, having a series of lateral ridges, which slopes upwardly toward the crest surface for engagement in pushing the switch forwardly. Surrounding the surfaces 148, 150 and 152 is a peripheral skirt 154 having on its outside surface an indicator bar 155 cooperating with indicia on the top surface of top wall 34 to provide visual indication of the position of the spool valve 92.

Figure 8:
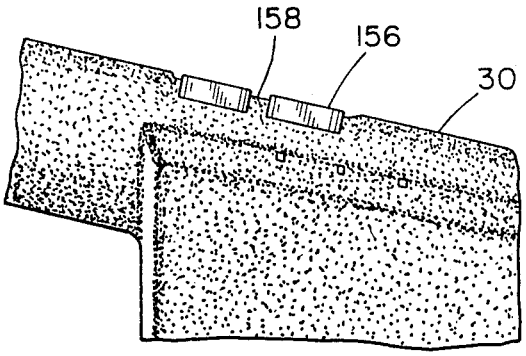
FIG. 8 is a side elevational view of a portion of the upper body.
Figure 13:
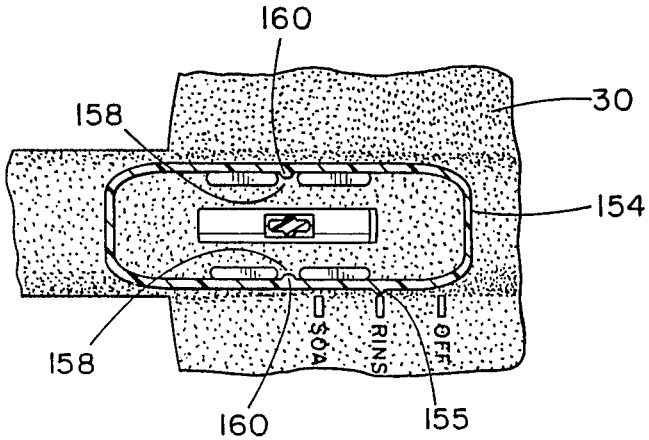
FIG. 13 is a plan view of a portion of the upper body of the brush with the top of the thumb switch removed to show the position of detents of the switch when the spool is in its "rinse" position.

Referring to FIGS. 7, 8 and 13, extending from top wall 34 and encompassed by the skirt 154 are a pair of longitudinally extending ridges 156. Each ridge is split, having a void 158. The skirt 154 carries a pair of interior ribs 160 which are shown in FIG. 13 as being disposed in the voids 158 when the spool valve is in its intermediate "rinse" position. The ribs 160 and portions of the ridges 156 defining the voids 158 have cam surfaces. The protuberances 125 received in stem window 124 hold the thumb engagement piece 114 closely adjacent the top wall 34. Movement of the switch 28 from the rinse position requires the ribs 160 to be lifted over the ridges 156. As the spool valve is somewhat transversely flexible and the O-rings held by it are resilient, the switch can be moved from the rinse position without dislocation of the protuberances from the window. However, the slight upward movement of the piece 114 as it is longitudinally moved from the rinse position provides a tactile indication of the rinse position. As the limits of the slot 112 signify the off and soap positions, the operator can tell by feel the operating mode of the brush without necessarily looking at it.

The upper body portion 30, the conduit 26 and the thumb switch 28 are preferably formed of acrylonitrile, butadiene, and styrene (ABS) plastic. The O-rings are preferably formed of an elastomeric copolymer of ethylene and propylene. The base 32 is preferably formed of polypropylene, the gasket 56 preferably formed of neoprene and the spool valve 92 preferably made of styrene.

Operation of the brush 20 of the present invention is as follows: After the liquid soap or soap crystals are inserted into the rear compartment 62 and the soap cap 90 is tightened to close port 84 and the garden hose is connected to the threaded end of the conduit 26, the water is turned on. First the spool valve 92 is moved to its rinse position (FIG. 5) causing water to flow into the forward compartment 60 through the spool valve opening 98 and second apertures 68. The water streams out through the nozzle 74 allowing, for example, the vehicle to be wetted. Next the operator pulls the thumb engageable piece 114 rearwardly to the soap position (FIG. 4). This causes water to enter the rear compartment 62 through spool valve opening 98 and the first apertures 70 extending through the locating pins 72. After the soap mixes with the water and the sponge material 82 becomes saturated, soapy water is expelled amongst the bristles through the holes 80. The brush is then used to scrub, with the bristles in the presence of the soapy water, to dissolve or suspend the dirt. The thumb switch 28 is then returned to the rinse position causing clear water to be expelled through the nozzle to wash away the dirty soapy water. By moving the thumb switch to the off position (FIG. 6), the flow of water is terminated. It will be appreciated that the brush of the present invention, unlike prior art car washing brushes, can be used with one hand. This is because the spool valve is, in essence, a linear actuator and because the thumb switch is disposed adjacent the conduit which serves as a handle for the brush.

In view of the above, it will be seen that the several objects of the invention are achieved and other advantageous results attained.

As various changes could be made without departing from the scope of the invention, it is intended that all matter contained in the above description shall be interpreted as illustrative and not in a limiting sense.

What is claimed is:

1. A washing, scrubbing and rinsing brush for home use such as washing cars and patios, said brush comprising:

a body having a plurality of dependent bristles, said body defining a first compartment for receiving soap and a second compartment for receiving rinse water, said first and second compartments being separated by a barrier wall, said body further including an elongate tube partially defining each of said compartments said first compartment having a first outlet means for providing soapy water to said bristles and said second compartment having a second outlet means for providing rinse water;

a conduit connected to said tube and adapted for connection to a garden hose;

a spool valve slidable back and forth in said tube, said valve having a substantially cylindrical wall defining an axial bore open to said conduit and an opening extending through said wall for communicating water to either of said compartments, said tube having a first aperture for providing water to said first compartment and a second aperture for providing water to said second compartment;

sealing means carried by said spool valve flanking said spool valve opening providing substantially watertight seals between said spool valve and said tube; and means for reciprocating said spool valve along a substantially linear path among a soap position wherein said first aperture is flanked by said sealing means so that said liquid can flow from said valve to said first compartment through said opening and said first aperture, a rinse position wherein said second aperture is flanked by said sealing means so that liquid can flow from said valve to said second compartment through said opening and said second aperture, and an off position wherein neither of said apertures is in fluid communication with said valve whereby movement of said spool valve to said soap position causes soapy water to be provided to said bristles, movement of said spool valve to said rinse position results in clear water being provided by the second outlet means, and movement of said spool valve to said off position shuts off the supply of water to said compartments.

2. A brush as set forth in claim 1 wherein said body comprises an upper body portion and a base attached to said upper body portion, said upper body portion and said conduit being integral.

3. A brush as set forth in claim 1 wherein said first outlet means comprises a plurality of holes positioned among the bristles.

4. A brush as set forth in claim 1 wherein said second outlet means comprises a nozzle positioned adjacent the front of said brush.

5. A brush as set forth in claim 1 wherein said means for reciprocating comprises a thumb switch extending above said body, said conduit serving as a handle for said brush and said thumb switch being positioned adjacent said conduit whereby said brush can be held and said thumb switch operated using only one hand.

6. A brush as set forth in claim 1 further comprising a layer of open cell sponge material covering said first outlet means, and means holding said layer over said first outlet means.

7. A brush as set forth in claim 1 wherein said body comprises an upper body portion which includes said elongate tube, said upper body portion including an elongate slot opening onto said tube, said means for reciprocating comprising a thumb switch having a thumb engagement piece and a mounting stem dependent therefrom, said stem extending through said slot.

8. A brush as set forth in claim 7 wherein said spool valve comprises a recess receiving said stem in an interference fit, said recess being defined by walls disposed inside said axial bore and isolating said recess from said bore.

9. A brush as set forth in claim 8 wherein said stem has a window and opposing ones of the walls defining said recess have protuberances which are received by said window when said stem is fully inserted into said recess.

10. A brush as set forth in claim 7 wherein said upper body portion and said thumb engagement piece include means providing a tactile indication when said spool valve is in the center position of its three positions.

11. A brush as set forth in claim 7 wherein said sealing means comprises a first O-ring and a second O-ring, said spool valve comprising flanges holding said O-rings flanking said spool valve opening.

12. A brush as set forth in claim 11 further comprising a third O-ring carried by said spool valve sealing the forward end of said spool valve from said compartments.

13. A brush as set forth in claim 11 further comprising a fourth O-ring carried by said spool valve sealing the slot from said conduit.

14. A brush as set forth in claim 11 further comprising a fifth O-ring carried by said spool valve sealing said slot from said first compartment.

15. A brush as set forth in claim 6 further comprising at least one pin extending into said first compartment from said tube, said means holding said layer comprising said pin.

16. A brush as set forth in claim 15 wherein said first aperture extends through said pin.

17. A washing, scrubbing and rinsing brush adapted to be connected to a garden hose for home uses such as cleaning automobiles and patios, said brush comprising:

a body with a front end and a rear end and having a plurality of dependent tufts of bristles, said body defining a forward compartment for receiving rinse water and a rear compartment for receiving soap, said compartments being separated by a barrier wall, said body further including an elongate tube extending from said rear end and terminating in an end wall adjacent said front end and partially defining each of said compartments, said rear compartment having outlet means for providing soapy water to said bristles and inlet means for introducing soap into said rear compartment, said body further having nozzle means adjacent said front end for dispensing rinse water from said forward compartment;

a conduit extending from said rear end and connected to said tube, said conduit having a distal end for connection to a garden hose;

a spool valve slidable back and forth in said tube, said valve having a cylindrical wall defining an axial bore extending therethrough, said valve further having an opening extending through said cylindrical wall for communicating water to either of said compartments, said tube having a first aperture for providing water to said rear compartment and a second aperture for providing water to said forward compartment;

first sealing means carried by said spool valve flanking said spool valve opening providing substantially water tight seals between said valve and said tube; and means for reciprocating said valve along a substantially linear path between a rinse position wherein said second aperture is flanked by said sealing means and a rear soap position wherein said first aperture is flanked by said sealing means.

18. A brush as set forth in claim 17 further comprising a second sealing means carried by said spool valve for sealing the forward end of said valve from said second aperture, said means for reciprocating enabling movement of said valve to an off position in which neither of said apertures is in fluid communication with said valve.

19. A brush as set forth in claim 18 wherein said off position is forward of said rinse position.

* * * * *